US006286468B1

(12) United States Patent
Warren

(10) Patent No.: US 6,286,468 B1
(45) Date of Patent: Sep. 11, 2001

(54) VOLUME REDUCING PISTON

(76) Inventor: Edward Lawrence Warren, 3912 Snowy Egret Dr., West Melbourne, FL (US) 32904

( * ) Notice: Subject to any disclaimer, the term of this patent is extended or adjusted under 35 U.S.C. 154(b) by 0 days.

(21) Appl. No.: 09/680,405

(22) Filed: Oct. 6, 2000

(51) Int. Cl.[7] ..... F02B 75/04
(52) U.S. Cl. ..... 123/48 AA; 128/78 A
(58) Field of Search ..... 123/48 A, 48 AA, 123/78 A

(56) References Cited

U.S. PATENT DOCUMENTS

| | | | | |
|---|---|---|---|---|
| 4,033,304 | * | 7/1977 | Luria | 123/78 A |
| 4,202,300 | * | 5/1980 | Skay | 123/48 D |
| 4,516,537 | * | 5/1985 | Nakahara et al. | 123/48 AA |
| 4,987,863 | * | 1/1991 | Daly | 123/48 AA |
| 5,195,469 | * | 3/1993 | Syed | 123/48 A |
| 5,341,771 | * | 8/1994 | Riley | 123/48 AA |
| 6,116,222 | | 9/2000 | Warren | 123/543 |

FOREIGN PATENT DOCUMENTS

| | | | |
|---|---|---|---|
| 0029733 | 2/1987 | (JP) | 123/48 R |
| 0216033 | 8/1989 | (JP) | 123/48 R |
| 406280609 | 10/1994 | (JP) | 123/48 R |

* cited by examiner

*Primary Examiner*—Marguerite McMahon

(57) ABSTRACT

The addition of volume reducing piston 28 to a "Two stroke engine with a plunger" through cylinder head 4 so that volume reducing piston 28 can get between cylinder head 4 and plunger body 11 and reduce the amount of fluid sucked into the engine. Also added to the engine is spring 34 to move volume reducing piston 28, and electro magnet 38 so that volume reducing piston 28 does not move at selected times. When electro magnet 38 is energized, volume reducing piston 28 is caught by electro magnet 38, so that volume reducing piston 28 does not move from cylinder head 4 when plunger body 11 goes to the bottom of its stroke, the amount of fluid to be compressed is not reduced, and the engine operates in a greater power output mode. When electro magnet 38 is not energized, both plunger body 11 and volume reducing piston 28 go the bottom of the stroke, the amount of fluid to be compressed is reduced and the engine operates in an efficient reduced power mode with almost complete expansion of the fluid-fuel charge.

6 Claims, 7 Drawing Sheets

VOLUME REDUCING PISTON

BACKGROUND—FIELD OF INVENTION

Figure 1C:
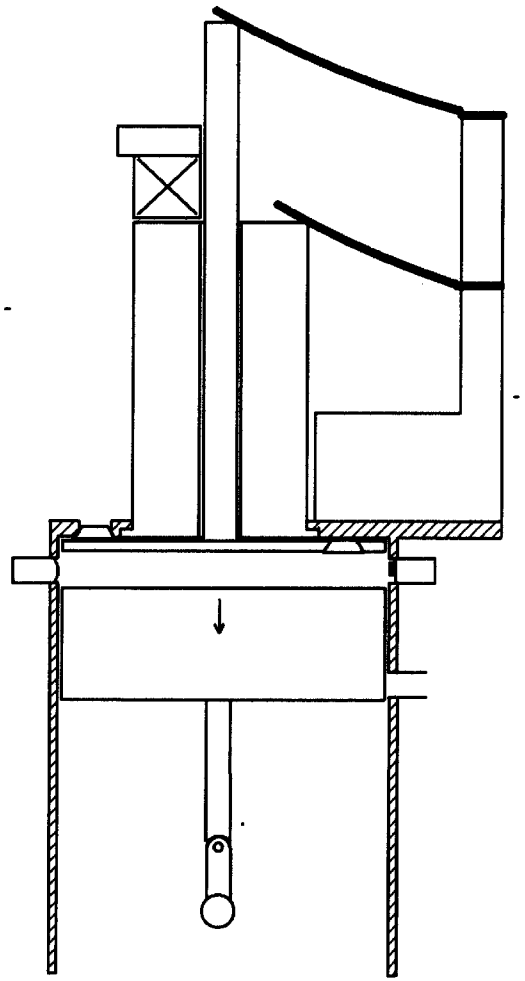

The present invention relates to, reciprocating, two stroke internal combustion engines that are able to change the amount of fluid compressed while operating; thereby effectively changing the size and power output of the engine.

BACKGROUND—DESCRIPTION OF PRIOR ART

Present two stroke engines with exhaust ports compress the same amount of fluid at all operating conditions. They do not change the amount compressed to vary the power of the engine. This invention is a modification of a two stroke, internal combustion, reciprocating, engine with exhaust ports, made up of a number of similar working its. Each working unit is comprised of a cylinder that is closed at one end by a cylinder head and contains a movable power piston that is connected to a power output shaft. Means are provided (a plunger body) to suck in the working fluid and push the exhaust out of the cylinder. This plunger body can move between the power piston and the cylinder head, and means are provided to accomplish this movement at the appropriate times during the engine's operating cycle. The plunger body is a movable wall that has attached to it valves that open to allow air to flow through the movable wall while the plunger body is moving away from the piston, and close to form a suction plunger body while the plunger body is moving towards the piston. Means are provided to move the plunger body, and means are provided for the introduction of fuel into the cylinder during the heating stroke. Engines of this type are the subject of patent: Warren (Sep. 12, 2000, U.S. Pat. No. 2,116,222) and patent application: Warren (August 1999, application Ser. No. 09/383,605). To vary the power of an engine while it is running, the fuel to fluid ratio is varied and this varies the temperature. As the temperature varies from the design temperature, the efficiency of the engine decreases. The solution to the problem of varying the power of the engine without losing efficiency was addressed in the above patent by positioning the exhaust valve on the plunger stem and limiting the travel of the plunger body. The drawback to this solution is that it does not allow the use of an exhaust port.

SUMMARY

This invention is: The addition of a volume reducing piston to a "two stroke engine with a plunger" through the cylinder head so that the volume reducing piston can get between the cylinder head and the plunger body and reduce the amount of fluid sucked into the engine. Also added to the engine is a spring to move the volume reducing piston, and an electro magnet so that the volume reducing piston does not move at selected times. When the electro magnet is energized, the volume reducing piston is caught by the electro magnet, so that the volume reducing piston does not move from the cylinder head when the plunger body goes to the bottom of its stroke, the amount of fluid to be compressed is not reduced, and the engine operates in its greater power output mode. When the electro magnet is not energized, both the plunger body and the volume reducing piston go the bottom of the stroke, the amount of fluid to be compressed is reduced and the engine operates in an efficient reduced power mode with almost complete expansion of the fluid-fuel charge.

Objects and Advantages

The advantage of "A Volume Reducing Piston For Varying The Amount of Fluid Compressed in a Two Stroke Engine" is: The engine can be operated at full power where it has the same efficiency as a four stroke engine, or it can be operated at reduced power where, because of increased expansion, it has more efficiency than at full power. Therefore, this engine will get more miles per gallon. In addition, since this is an improvement to an existing engine it will not require massive expense and development.

DRAWING FIGURES

Figure 1B:
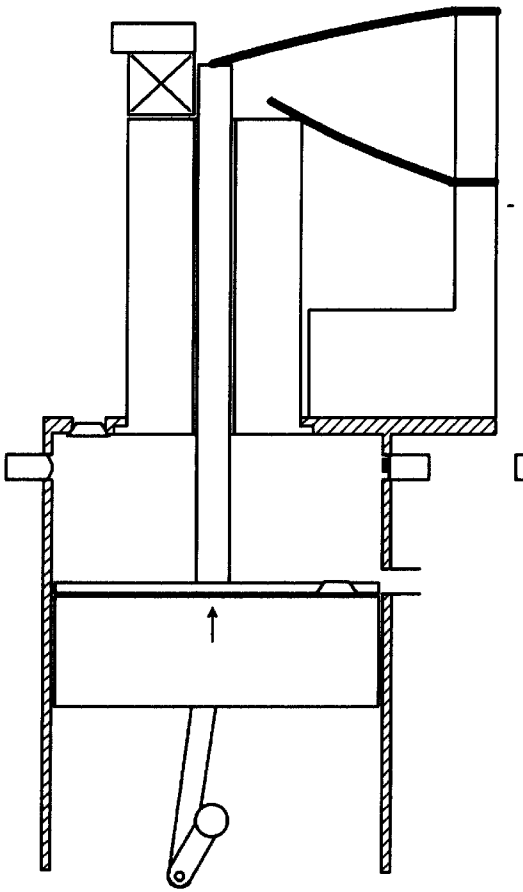
Figure 1A:
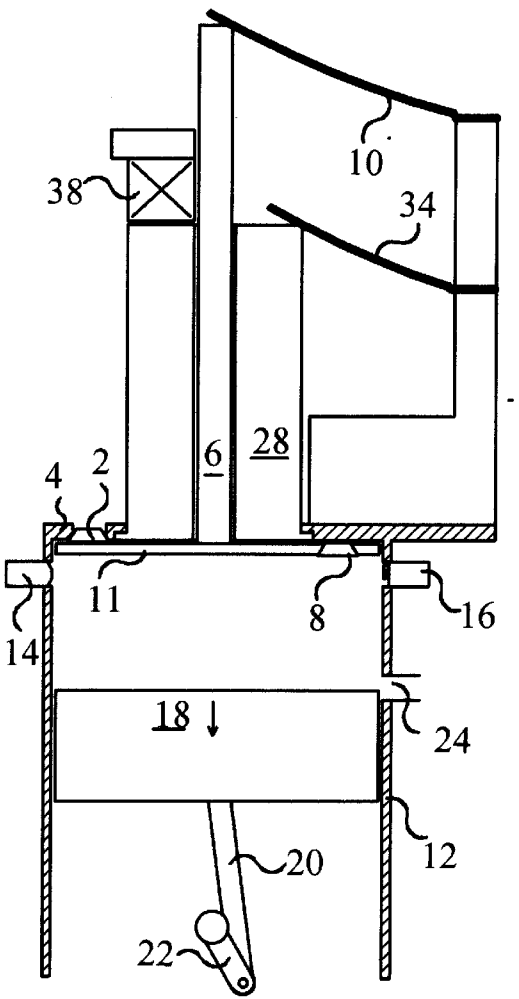

FIG. 1*a* depicts the engine at the start of the greater power inlet and exhaust cycle FIG. 1*b* depicts the engine at the start of the greater power compression cycle.

FIG. 1*c* depicts the engine at the start of the greater power expansion cycle.

Figure 2C:
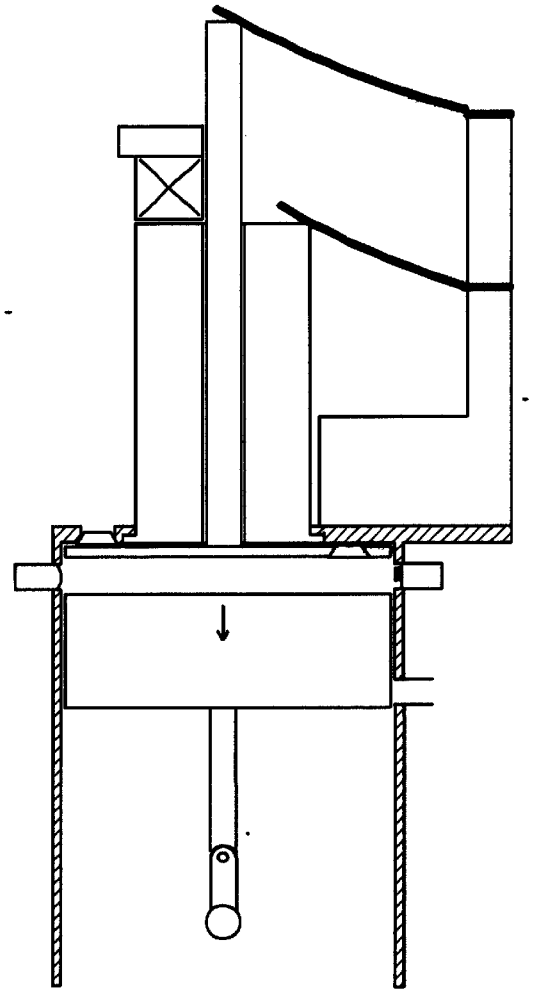
Figure 2B:
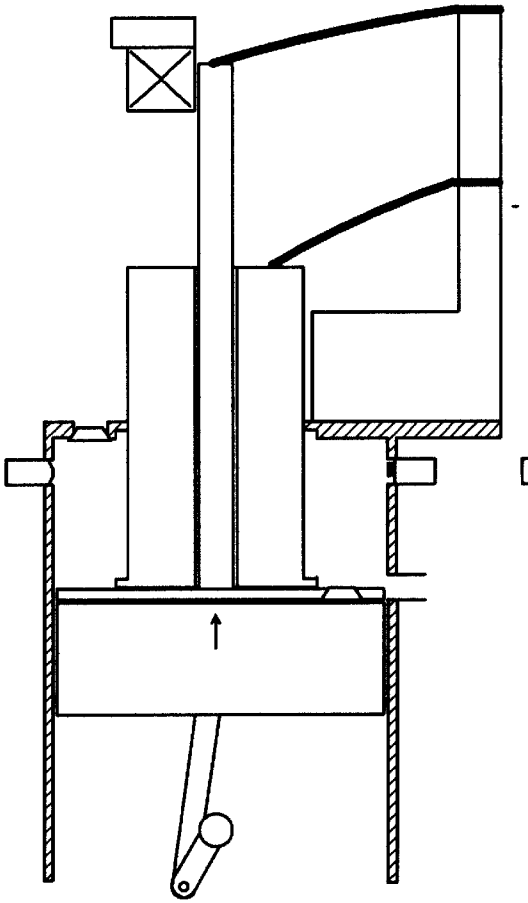
Figure 2A:
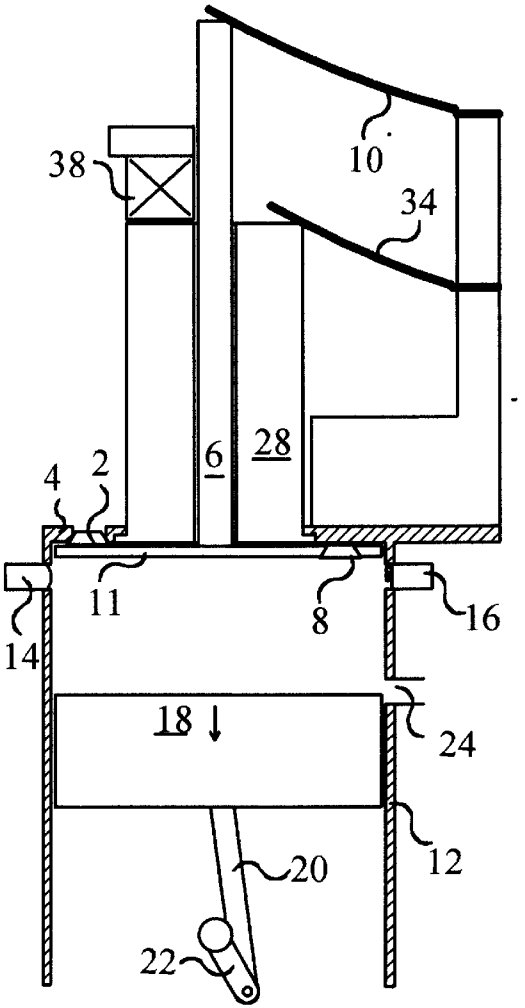

FIG. 2*a* depicts the engine at the start of the less power and greater efficiency inlet and exhaust cycle.

FIG. 2*b* depicts the engine at the start of the less power and greater efficiency compression cycle.

FIG. 2*c* depicts the engine at the start of the less power and greater efficiency expansion cycle.

Figure 3:
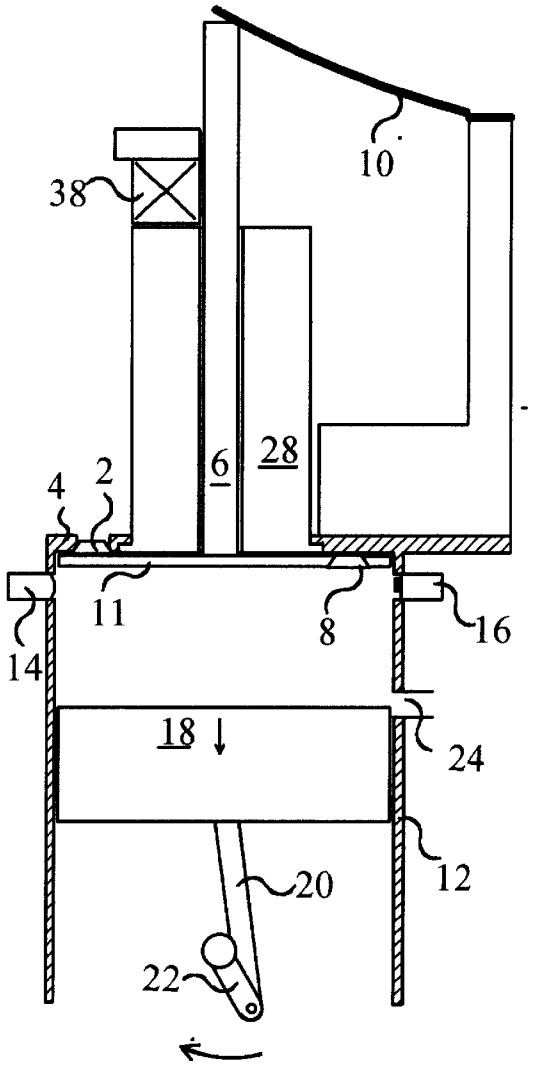

FIG. 3 depicts the first alternate embodiment of the invention

Figure 4C:
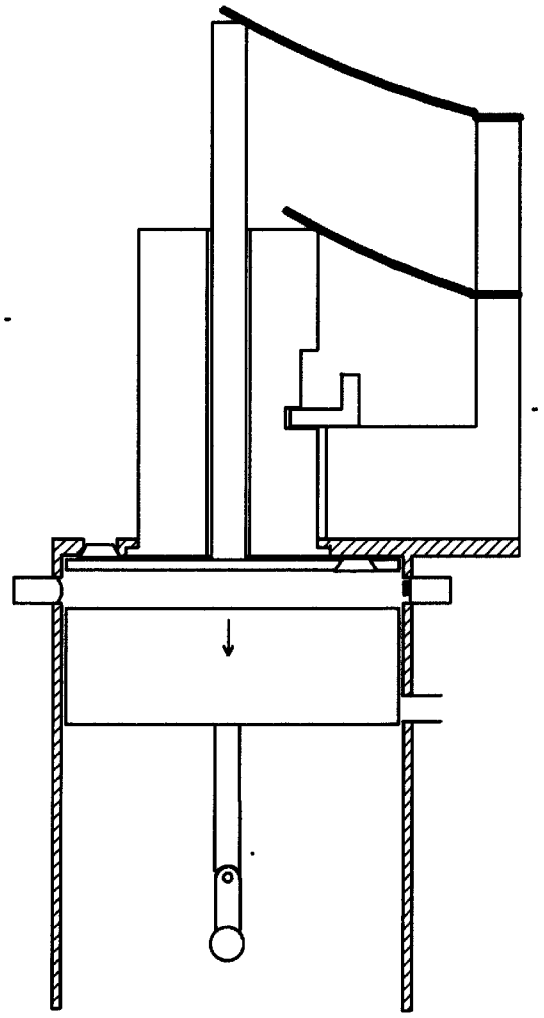
Figure 4B:
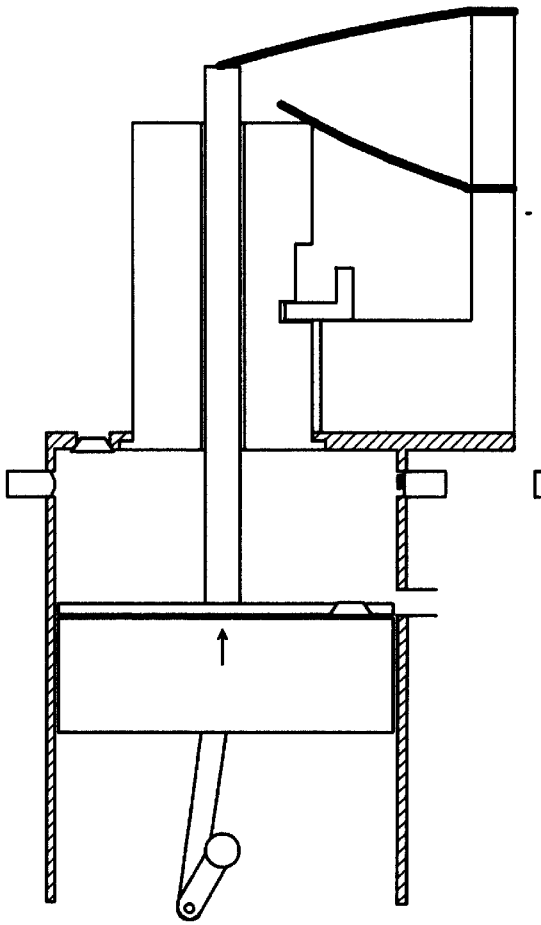
Figure 4A:
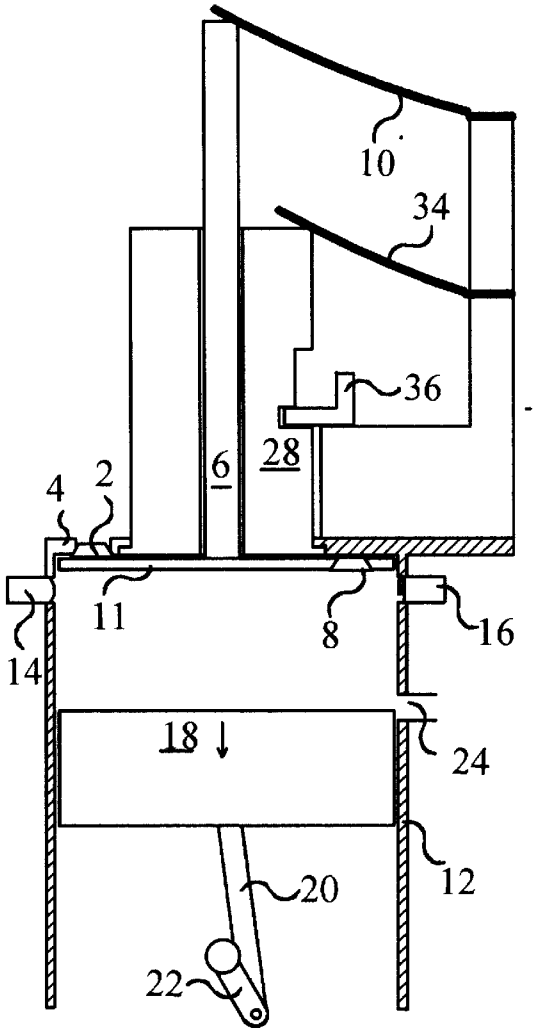

FIG. 4*a* depicts the second alternate embodiment of the invention at the start of the greater power inlet and exhaust cycle.

FIG. 4*b* depicts the second alternate embodiment of the invention at the start of the greater power compression cycle.

FIG. 4*c* depicts the second alternate embodiment of the invention at the start of the greater power expansion cycle.

Figure 5C:
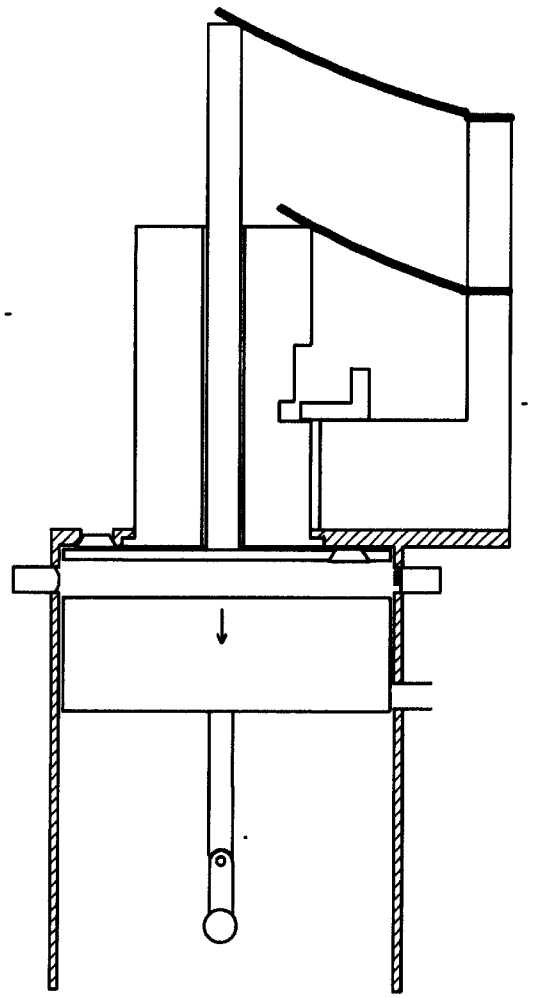
Figure 5B:
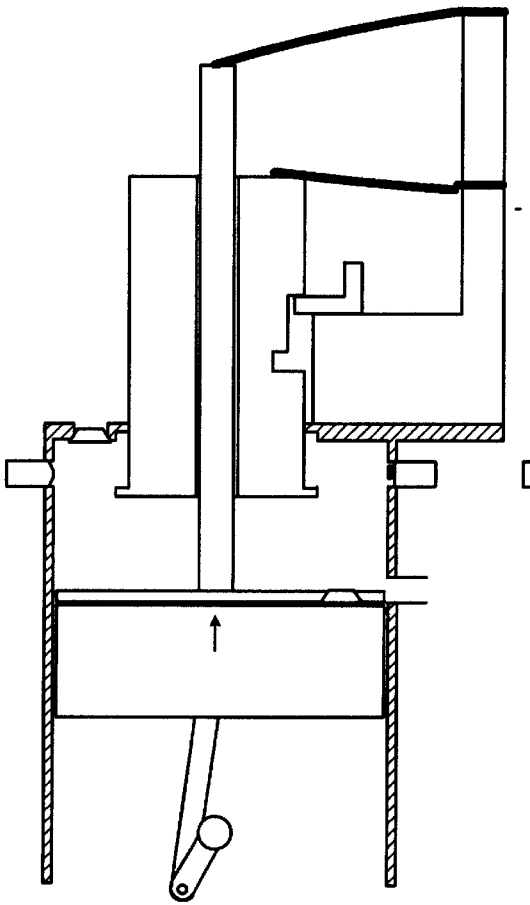
Figure 5A:
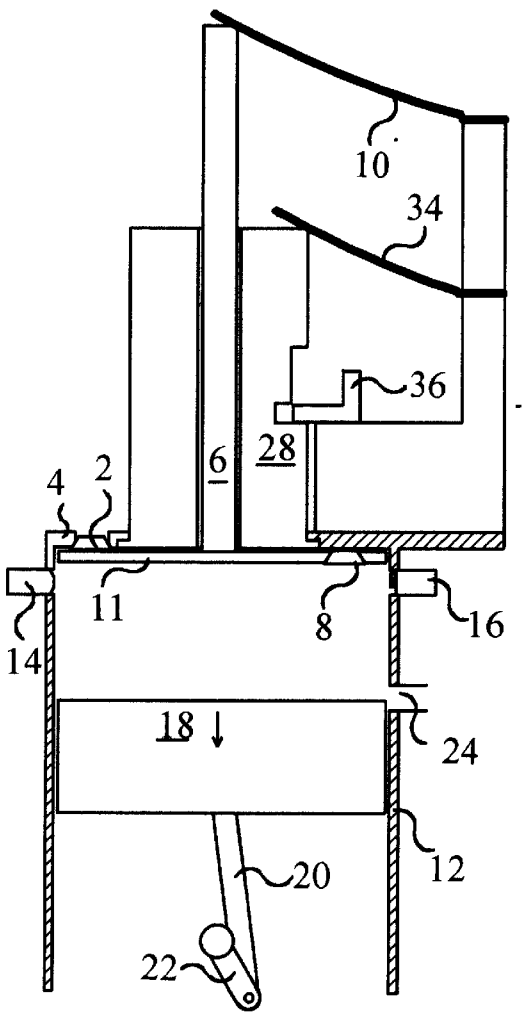

FIG. 5*a* depicts the second alternate embodiment of the invention at the start of the medium power and greater efficiency inlet and exhaust cycle.

FIG. 5*b* depicts the second alternate embodiment of the invention at the start of the medium power and greater efficiency compression cycle.

FIG. 5*c* depicts the second alternate embodiment of the invention at the start of the medium power and greater efficiency expansion cycle.

Figure 6C:
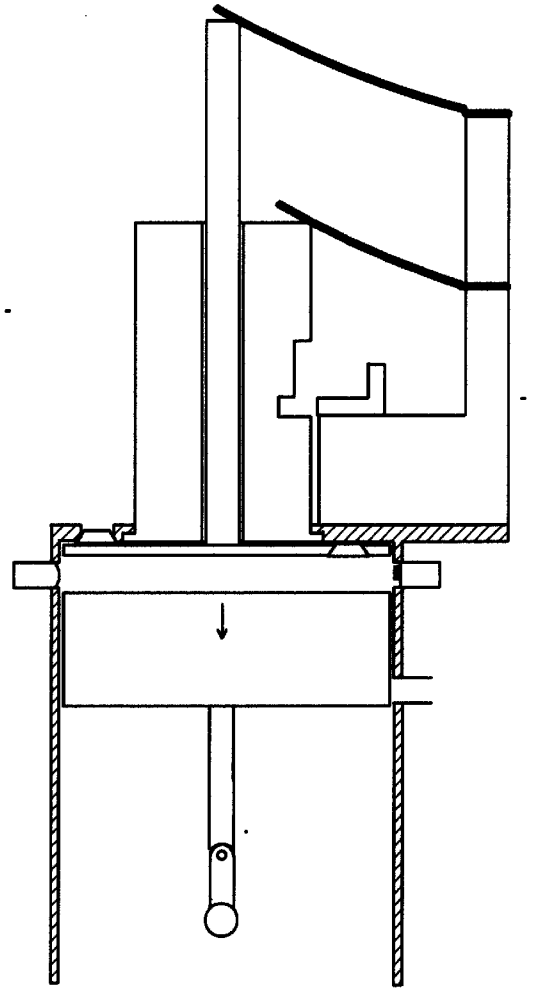
Figure 6B:
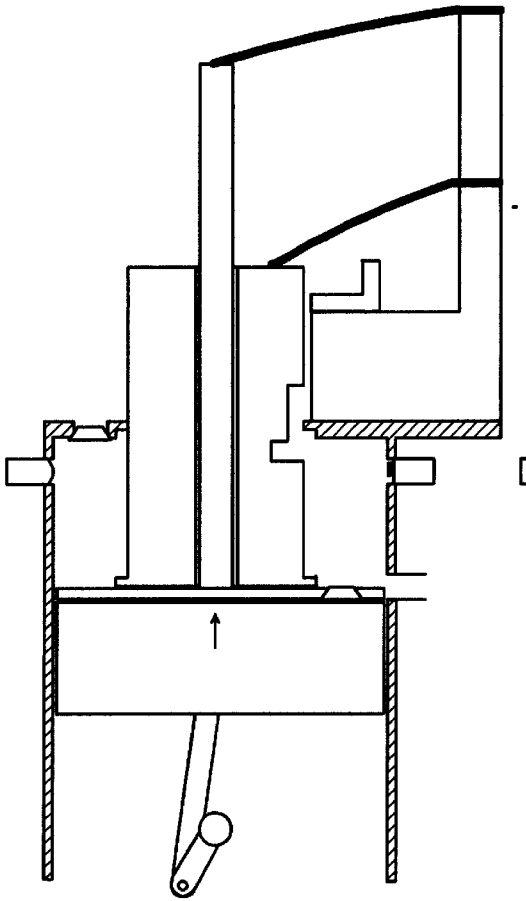
Figure 6A:
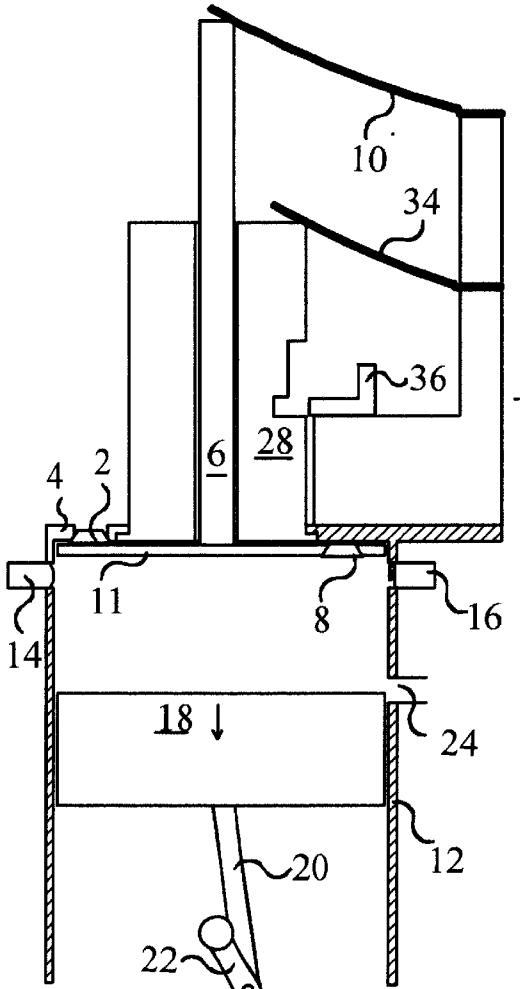

FIG. 6*a* depicts the second alternate embodiment of the invention at the start of the less power and greater efficiency inlet and exhaust cycle.

FIG. 6*b* depicts the second alternate embodiment of the invention at the start of the less power and greater efficiency compression cycle.

FIG. 6*c* depicts the second alternate embodiment of the invention at the start of the less power and greater efficiency expansion cycle.

Figure 7:
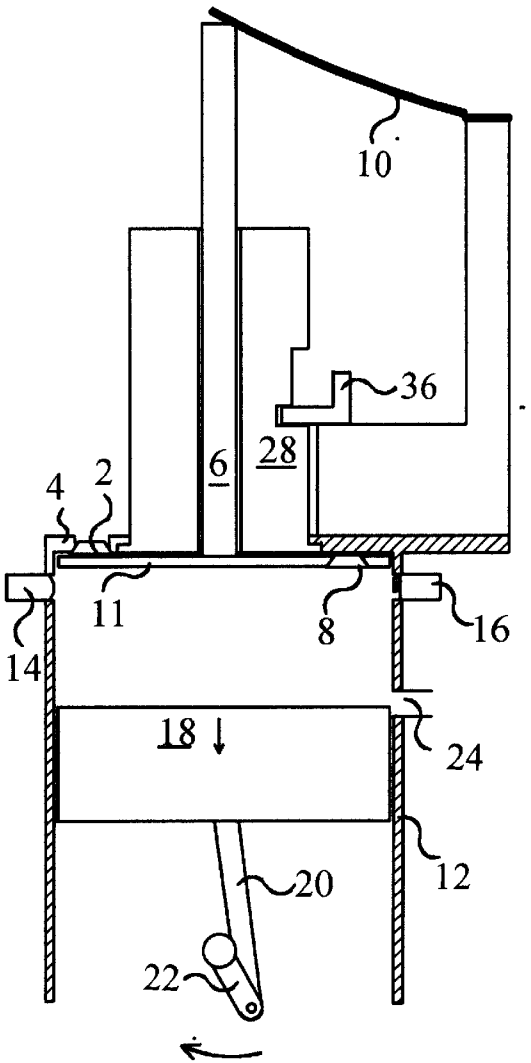

FIG. 7 depicts the third alternate embodiment of the invention.

REFERENCE NUMERALS IN DRAWINGS

2 air inlet valve
4 cylinder head
6 plunger stem
8 plunger valve
10 plunger spring
11 plunger body
12 cylinder
14 fuel injector
16 igniter
18 power piston
20 connecting rod

22 power output shaft
24 exhaust port
28 volume reducing piston
34 spring
36 lock
38 electro magnet DESCRIPTION—FIGS. 1 and 2—Preferred Embodiment This invention is: the insertion of volume reducing piston 28 through cylinder head 4 around plunger stem 6. The addition of spring 34, and electro magnet 38. Electro magnet 38 keeps volume reducing piston 28 from moving with plunger stem 6 at selected times.

The engine that uses this invention is a two stroke reciprocating, internal combustion engine employing a plunger body 11. The operation of the engine is two strokes divided into three cycles. The first cycle is the intake and the exhaust cycle. The second is the compression cycle, and the third is the expansion cycle. The expansion cycle is from about top dead center to about 85% of the downward travel of power piston 18 (or as measured by power output shaft 22 rotation from top dead center to about 135 degrees). The intake and exhaust cycle is from about 85% of the downward travel of power piston 18 (135°) to about 15% of the travel back up (225°). The compression cycle is from about 15% of the travel back up of power piston 18 (225°) to about top dead center. The above positions are all estimates and are given for descriptive purposes only. The actual position a cycle may begin or end at, may be different from those set out above.

FIGS. 1 and 2 illustrate schematically an internal combustion engine suitable for practice of this invention. Only one set of components for such an engine is illustrated; however, what is illustrated will function as a complete engine if it has an inertial load. It will be understood that this is merely representative of one set of components. A plurality of such structures joined together would make up a larger engine. Other portions of the engine are conventional. Thus, the bearings, seals etc. of the engine are not specifically illustrated. The valves illustrated are but one type out of many that could be used. For example plunger valve 8 could be a pressure actuated valve commonly called a check valve. Plunger body 11 that along with plunger stem 6 is moved down by plunger spring 10 could be moved by other means such as a cam shaft, hydraulics, or pneumatics. Volume reducing piston 28 could be another piston adjacent to plunger stem 6 instead of being concentric around plunger stem 6. Although only one set is discussed here, there can be any number of sets of electro magnets 38, and plunger stems 6. Each set defines a new size compressor for the engine.

Cylinder 12 is closed at one end by cylinder head 4 that contains volume reducing piston 28, plunger stem 6, and air inlet valve 2. Attached above volume reducing piston 28 is electro magnet 38 and spring 34. Cylinder 12 air inlet valve 2, and plunger body 11. Cylinder 12 further contains fuel injector 14; power piston 18 which is connected to power output shaft 22 by a connecting rod 20 (for converting the linear motion of power piston 18 to the rotating motion of power output shaft 22); and igniter 16. (All of the engine embodiments presented herein utilize a spark plug for ignition of the fuel. While recognizing that igniter 16 may only be required for starting, such an ignition source is included in every embodiment and claim.).

Air inlet valve 2 allows air to enter the engine. It can be any of a variety of valves including those referred to as check valves or one way valves. Fuel injector 14 can be an off the shelf injector that injects fuel into cylinder 12. The engine can also be carbureted. Igniter 16 can be on off the shelf igniter that ignites the fuel. The expanding gases exert a force on power piston 18, (a cylindrical piston that can move up and down in cylinder 12). That force, exerted on power piston 18 moving it down, is transmitted via connecting rod 20 and power output shaft 22 to a load (not shown). Cylindrically shaped plunger body 11 houses plunger valve 8.

FIGS. 1 and 2—Operation of Preferred Embodiment

In the operation of the two stroke engine using the invention, plunger body 11 makes two strokes each three cycles, a stroke towards power piston 18, which takes place after the end of the expansion cycle and causes the air intake and exhaust cycle, and a stroke towards cylinder head 4 which takes place during the compression cycle. Plunger body 11 never moves during the expansion cycle. For greater power operation, volume reducing piston 28 does not move. It is held fast by electro magnet 38. For less power but greater efficiency operation, volume reducing piston 28 moves with plunger body 11 urged along by spring 34.

FIGS. 1*a*, 1*b*, and 1*c* present the sequence of steps or processes occurring with volume reducing piston 28 not moving for greater power operation of the engine. FIG. 1*a* depicts the engine at the end of the expansion cycle and the start of the inlet and exhaust cycle, and FIG. 1*b*, shows the engine at the end of the air intake and exhaust cycle and the start of the compression cycle. FIG. 1*c* shows the engine at the end of the compression cycle and at the start of the expansion cycle. The air intake and exhaust cycle takes place between FIGS. 1*a* and 1*b*. The compression cycle takes place between FIGs. 1*b* and 1*c*. And the expansion cycle takes place between FIGs. 1*c* and 1*a*.

For greater power operation, the air intake and exhaust cycle begins as shown in FIG. 1*a* with volume reducing piston 28, and plunger body 11 adjacent to cylinder head 4, and power piston 18 at exhaust port 24. Then as plunger body 11 moves toward power piston 18, it forces out exhaust and sucks in fresh air. Volume reducing piston 28 does not move (electro magnet 38 is energized). The air intake and exhaust cycle ends when plunger body 11 is adjacent to power piston 18 as shown in FIG. 1*b*. The compression cycle starts and the large volume of fluid between plunger body 11 and cylinder head 4 is compressed, and the compression cycle ends when power piston 18 is near the top of its travel as shown in FIG. 1*c*. Then greater power expansion takes place, and ends when power piston 18 uncovers exhaust port 24 as shown in FIG. 1*a*.

FIGS. 2*a*, 2*b*, and 2*c* present the sequence of steps or processes occurring with volume reducing piston 28 not caught for less power and greater efficiency operation of the engine. FIG. 2*a* depicts the engine at the end of the expansion cycle and the start of the inlet and exhaust cycle, and FIG. 2*b*, shows the engine at the end of the air intake and exhaust cycle and the start of the compression cycle. FIG. 2*c* shows the engine at the end of the compression cycle and at the start of the expansion cycle. The air intake and exhaust cycle takes place between FIGS. 2*a* and 2*b*. The compression cycle takes place between FIGS. 2*b* and 2*c*. And the expansion cycle takes place between FIGS. 2*c* and 2*a*.

For less power but greater efficiency operation, electro magnet 38 is not energized. The air intake and exhaust cycle begins as shown in FIG. 2*a* with volume reducing piston 28, and plunger body 11 adjacent to cylinder head 4, and power piston 18 at exhaust port 24. Volume reducing piston 28 is not caught by electro magnet 38 and moves with plunger body 11 urged along by spring 34. Then as plunger body 11 and volume reducing piston 28 move toward power piston 18, they force out exhaust gases and suck in less fresh air. The cycle ends when plunger body 11 and volume reducing piston 28 are adjacent to power piston 18 as shown in FIG. 2*b*. Then the smaller volume of fluid between plunger body 11 and cylinder head 4 is compressed, and the compression cycle ends when power piston 18 is near the top of its travel as shown in FIG. 2*c*. Then the less power but greater efficiency expansion takes place, and ends when power piston 18 uncovers exhaust port 24 as shown in FIG. 2*a*.

DESCRIPTION—FIG. 3—First Alternate Embodiment of the Invention

FIG. 3 shows the first alternate embodiment of the invention. It is the preferred embodiment of the invention with spring 34 deleted. The purpose of spring 34 is to urge along volume reducing piston 28, but there are some operating conditions where spring 34 is not needed because volume reducing piston 28 is urged along by pressure forces.

DESCRIPTION—FIGS. 4 to 6—Second Alternate Embodiment of the Invention

The second alternate embodiment of the mention uses the same two stroke engine with plunger that the preferred embodiment of the invention uses.

The second alternate embodiment of the invention is: the insertion of volume reducing piston 28 through cylinder head 4 around plunger stem 6; the addition of spring 34 to move volume reducing piston 28; and the addition of lock 36 to restrict the movement of volume reducing piston 28.

FIG. 4*a*, 4*b*, and 4*c* show the position of lock 36 for greater power operation of the engine. It is engaged such that volume reducing piston 28 never leaves the upmost position.

FIG. 5*a*, 5*b*, and 5*c* show the position of lock 36 for medium power and greater efficiency operation of the engine. It is engaged such that volume reducing piston 28 stops part of the way between cylinder head 4 and plunger body 11.

FIG. 6*a*, 6*b*, and 6*c* show the position of lock 36 for less power and greater efficiency operation of the engine. It is not engaged so that volume reducing piston 28 moves all the way between cylinder head 4 and plunger body 11.

FIGS. 4 to 6—Operation of Second Alternate Embodiment of the Invention

In the operation of the two stroke engine using the invention, plunger body 11 makes two strokes each three cycles, a stroke towards power piston 18, which takes place at the end of the expansion cycle and causes the air intake and exhaust cycle, and a stroke towards cylinder head 4 which takes place during the compression cycle. Plunger body 11 never moves during the expansion cycle. For greater power operation, volume reducing piston 28 does not move. It is locked at the top of its travel by lock 36. For medium power but greater efficiency operation, volume reducing piston 28 moves with plunger body 11 urged along by spring 34 to about half way between cylinder head 4 and plunger body 11. For less power but greater efficiency operation, volume reducing piston 28 moves with plunger body 11 urged along by spring 34 all the way to the bottom of plunger body 11 stroke.

FIGS. 4*a*, 4*b*, and 4*c* present the sequence of steps or processes occurring with volume reducing piston 28 not moving for greater power operation of the engine. FIG. 4*a* depicts the engine at the end of the expansion cycle and the start of the inlet and exhaust cycle, and FIG. 4*b*, shows the engine at the end of the air intake and exhaust cycle and the start of the compression cycle. FIG. 4*c* shows the engine at the end of the compression cycle and at the start of the expansion cycle. The air intake and exhaust cycle takes place between FIGS. 4*a* and 4*b*. The compression cycle takes place between FIGS. 4*b* and 4*c*. And the expansion cycle takes place between FIGS. 4*c* and 4*a*.

For greater power operation, the air intake and exhaust cycle begins as shown in FIG. 4*a* with volume reducing piston 28, and plunger body 11 adjacent to cylinder head 4, and power piston 18 at exhaust port 24. Then as plunger body 11 moves toward power piston 18, it forces out exhaust gases and sucks in fresh air. Volume reducing piston 28 does not move (lock 36 stays inside of volume reducing piston 28). The air intake and exhaust cycle ends when plunger body 11 is adjacent to power piston 18 as shown in FIG. 4*b*. The compression cycle starts and the large volume of fluid between plunger body 11 and cylinder head 4 is compressed, and the compression cycle ends when power piston 18 is near the top of its travel as shown in FIG. 4*c*. Then greater power expansion takes place, and ends when power piston 18 uncovers exhaust port 24 as shown in FIG. 4*a*.

FIGS. 5*a*, 5*b*, and 5*c* present the sequence of steps or processes occurring with volume reducing piston 28 caught for medium power and greater efficiency operation of the engine. FIG. 5*a* depicts the engine at the end of the expansion cycle and the start of the inlet and exhaust cycle, and FIG. 5*b*, shows the engine at the end of the air intake and exhaust cycle and the start of the compression cycle. FIG. 5*c* shows the engine at the end of the compression cycle and at the start of the expansion cycle. The air intake and exhaust cycle takes place between FIGS. 5*a* and 5*b*. The compression cycle takes place between FIGS. 5*b* and 5*c*. And the expansion cycle takes place between FIGS. 5*c* and 5*a*.

For medium power but greater efficiency operation, the air intake and exhaust cycle begins as shown in FIG. 5*a* with volume reducing piston 28, and plunger body 11 adjacent to cylinder head 4, and power piston 18 at exhaust port 24. Volume reducing piston 28 is caught by lock 36 about half way between cylinder head 4 and plunger body 11. Then as plunger body 11 moves toward power piston 18, it forces out exhaust gases and sucks in less fresh air. The cycle ends when plunger body 11 is adjacent to power piston 18 and volume reducing piston 28 is about half way between cylinder head 4 and plunger body 11 as shown in FIG. 5*b*. Then the medium volume of fluid between plunger body 11 and cylinder head 4 is compressed, and the compression cycle ends when power piston 18 is near the top of its travel as shown in FIG. 5*c*. Then the medium power but greater efficiency expansion takes place, and ends when power piston 18 uncovers exhaust port 24 as shown in FIG. 5*a*.

FIGS. 6*a*, 6*b*, and 6*c* present the sequence of steps or processes occurring with volume reducing piston 28 positioned for less power and greater efficiency operation of the engine. FIG. 6*a* depicts the engine at the end of the expansion cycle and the start of the inlet and exhaust cycle, and FIG. 6*b*, shows the engine at the end of the air intake and exhaust cycle and the start of the compression cycle. FIG. 6*c* shows the engine at the end of the compression cycle and at the start of the expansion cycle. The air intake and exhaust cycle takes place between FIGS. 6*a* and 6*b*. The compression cycle takes place between FIGS. 6*b* and 6*c*. And the expansion cycle takes place between FIGS. 6*c* and 6*a*.

For less power but greater efficiency operation, the air intake and exhaust cycle begins as shown in FIG. 6*a* with volume reducing piston 28, and plunger body 11 adjacent to cylinder head 4, and power piston 18 at exhaust port 24. Volume reducing piston 28 is released by lock 36 and moves with plunger body 11. Then as plunger body 11 moves toward power piston 18, it forces out exhaust gases and sucks in less fresh air. The cycle ends when plunger body 11 and volume reducing piston 28 are adjacent to power piston 18 as shown in FIG. 6*b*. Then the smaller volume of fluid between plunger body 11 and cylinder head 4 is compressed, and the compression cycle ends when power piston 18 is near the top of its travel as shown in FIG. 6*c*. Then the less power but greater efficiency expansion takes place, and ends when power piston 18 uncovers exhaust port 24 as shown in FIG. 6*a*.

DESCRIPTION—FIG. 7—Third Alternate Embodiment of the Invention

FIG. 7 shows the third alternate embodiment of the invention. It is the second alternate embodiment of the invention with spring 34 deleted. The purpose of spring 34 is to urge along volume reducing piston 28, but there are some operating conditions where spring 34 is not needed because volume reducing piston 28 is urged along by pressure forces.

Conclusion

Accordingly, the reader will see that "A Volume Reducing Piston 28" for varying the amount of fluid compressed in a two stroke engine meets the following objects and advantages:

The engine can be operated at full power where it has the same efficiency as a four stroke engine, or it can be operated at reduced power where, because of increased expansion, it has more efficiency than at full power. Therefore, this engine will get more miles per gallon.

Although the description above contains many specificities, these should not be construed as limiting the scope of the invention but as merely providing illustrations of some of the presently preferred embodiments of this invention. For example, the two stroke engine with a plunger has exhaust port 24. The engine could have an exhaust valve, and that exhaust valve could be on plunger stem 6.

What is claimed is:

1. The addition of the following to an internal combustion piston engine:

a volume reducing piston that is urged into said engine and out of said engine by the difference in air pressure between the inside and the outside of said engine, and a means to prevent said volume reducing piston from moving at selected times.

2. An engine as recited in claim 1 wherein the work of said difference in air pressure to urge said volume reducing piston into said engine is augmented with a spring.

3. An engine as recited in claim 1 wherein said means to prevent said volume reducing piston from moving at selected times is an electro magnet.

4. An engine as recited in claim 1 wherein said means to prevent said volume reducing piston from moving at selected times is a lock.

5. A process for operating an internal combustion piston engine, with a volume reducing piston that is urged into said engine and out of said engine by the difference in air pressure between the inside and the outside of said engine, and a means to prevent said volume reducing piston from moving at selected times when higher power operation is desired; that has the following steps:

1. said volume reducing piston is held in place by said means to prevent said volume reducing piston from moving;
2. the engine operates at higher power.

6. A process for operating an internal combustion piston, with a volume reducing piston that is urged into said engine and out of said engine by the difference in air pressure between the inside and the outside of said engine, and a means to prevent said volume reducing piston from moving at selected times when higher power operation is desired; that has the following steps for when lower power is desired:

1. said means to prevent said volume reducing piston from moving is disabled and said volume reducing piston is allowed to move;
2. as air is pulled into said engine, said volume reducing piston is pulled into said engine, along with a reduced amount of fresh air, the volume reducing piston taking up space and reducing the amount of fresh intake air;
3. as the air in said engine is compressed, a pressure difference is created that pushes said volume reducing piston out of said engine back to said volume reducing piston's original position;
4. reduced power expansion takes place.

* * * * *